United States Patent [19]

DeLong

[11] 4,223,944

[45] Sep. 23, 1980

[54] RETRACTABLE WHEELCHAIR TRAY MECHANISM

[76] Inventor: Harold D. DeLong, 1483 Manzanita, Escondido, Calif. 92027

[21] Appl. No.: 25,999

[22] Filed: Apr. 2, 1979

[51] Int. Cl.[2] ..... A47B 39/00

[52] U.S. Cl. ..... 297/148; 297/251; 297/DIG. 4

[58] Field of Search ..... 297/148, 149, 150, 194, 297/188, 145, 251, DIG. 4; 108/33, 67, 68, 42, 43

[56] References Cited

U.S. PATENT DOCUMENTS

| | | | |
|---|---|---|---|
| 1,177,862 | 4/1916 | Hammond | 297/251 |
| 2,530,239 | 11/1950 | Gillis et al. | 297/251 |
| 2,848,291 | 8/1958 | Hafekost et al. | 108/68 X |
| 3,102,500 | 9/1963 | Shaw | 108/43 |
| 3,999,798 | 12/1976 | Roulier | 297/150 |

FOREIGN PATENT DOCUMENTS

| | | | |
|---|---|---|---|
| 442274 | 2/1936 | United Kingdom | 297/145 |

*Primary Examiner*—Roy D. Frazier
*Assistant Examiner*—Peter A. Aschenbrenner

[57] ABSTRACT

A convenient tray is provided for a wheelchair wherein the tray retracts onto a housed roll mounted beneath one armrest of a conventional wheelchair and extends across the lap of the wheelchair victim to be engaged by a releasable catch mechanism beneath the opposite armrest. The sheet material of which the tray is made has a transverse upwardly convex arch over its length to provide it with rigidity when it is extended in the manner conventionally subscribed to by tape measures, this sheet becoming flexible in the longitudinal direction for rolling when the sheet is retracted onto its roller.

3 Claims, 7 Drawing Figures

RETRACTABLE WHEELCHAIR TRAY MECHANISM

BACKGROUND OF THE INVENTION

The invention is in the field of aids to invalids and particularly pertains to providing an amenity for wheelchair victims. Whereas a basic wheelchair clearly provides mobility to an otherwise immobile victim, a conventional wheelchair leaves a lot to be desired in the way of different conveniences and aids to the wheelchair victim. typically, for example, although there may be a rack alongside the wheelchair to enable the victim to carry books and packages, there is no conveniently extendable tray or shelf which the operator can extend in front of him to support food, beverages, or a book.

SUMMARY OF THE INVENTION

The present invention accommodates the above-stated deficiency by providing a tray which is extremely light weight, and when not in use, is virtually completely out of the way by virtue of being coiled upon a spring-loaded roller in the same fashion as is a tape measure or a window shade. When extended, the leading edge of the resilient sheet is engaged by a hand-releasable catch mechanism mounted beneath the opposite armrest of the wheelchair. The resilient sheet member is upwardly convex in transverse cross section to define a cylindrical segment so that it is rigidly deployed as is a tape measure, provided it maintains its arch. When the arch is transversely straightened at the roller surface, the resilient sheet loses the beam strength provided by the arch and can be coiled like a tape measure.

The roller mechanism on one side of the wheelchair and the catch mechanism on the other are both designed as coherent units which can be mounted beneath the respective armrests of existing wheelchairs by removing the screws which hold the armrests above the horizontal frame members to either side of the wheelchair victim. By virtue of the structure designed to accommodate this simple mounting procedure, the unit can be installed in most wheelchairs in a few minutes.

DETAILED DESCRIPTION OF THE PREFERRED EMBODIMENT

Figure 1:
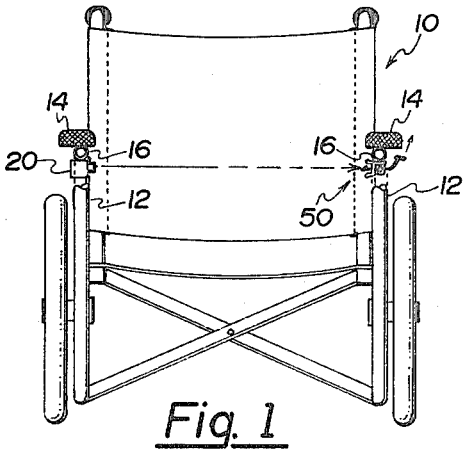
FIG. 1 is front elevation view of a typical wheelchair showing the tray mechanism installed and retracted.
Figure 6:
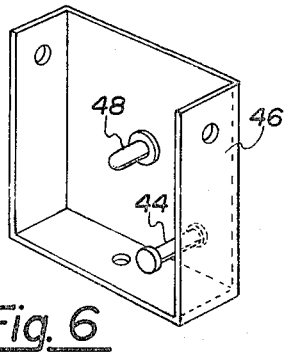
FIG. 6 is a perspective view of the end cap of the roller shell.

As can be seen in FIG. 1, a wheelchair 10 is shown having a basic frame 12 with a pair of armrests 14 mounted over horizontal tubular frame members 16 which support same. According to conventional wheelchair construction, these armrests are connected to the horizontal frame members 16 by virtue of a pair of screws 18 which pass through the members into the wooden portion of the armrests.

Figure 4:
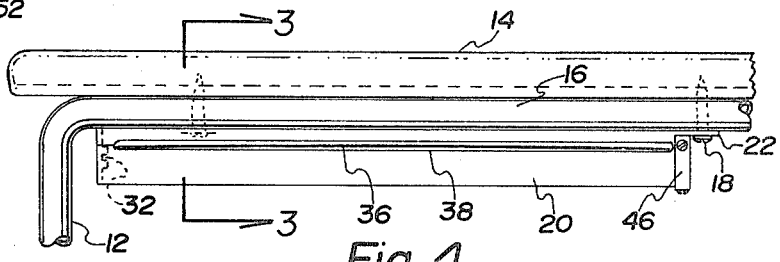
FIG. 4 is a side elevation view of the housing and frame member seen from between the armrests with the armrest shown in phantom.
Figure 3:
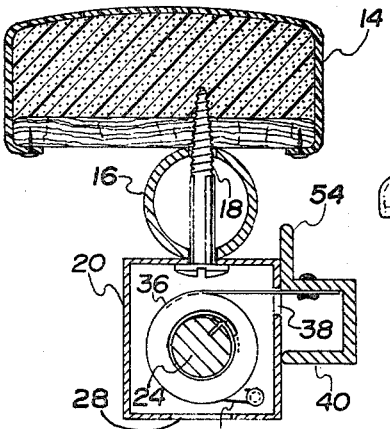
FIG. 3 is a sectional view taken along line 3—3 of FIG. 4.
Figure 5:
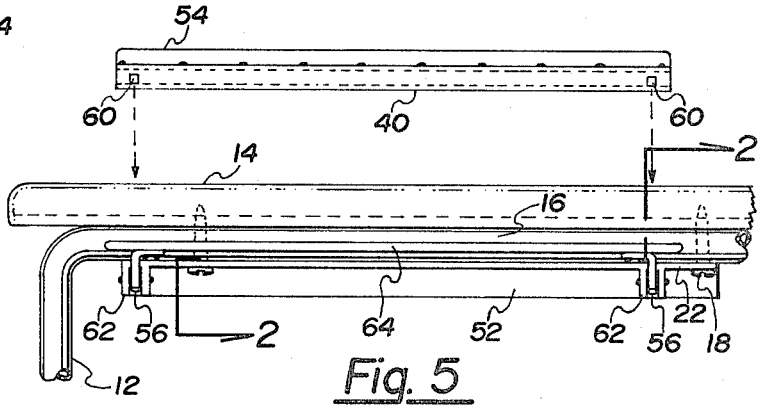
FIG. 5 is a side elevation view of the outside of the wheelchair arm of FIG. 1 (left arm) with the catch intalled and the leading edge of tray exploded.

In FIGS. 3 and 4 it can be seen that a elongated shell housing 20 has an extension flange or plate 22 and the shell, together with its flange, are provided with the appropriate holes to permit the passage therethrough of the screws 18 which are used in FIGS. 3 and 4 to fasten the shell 20 beneath the armrests. This is in fact accomplished when the roller 24, together with its rewind spring 26 are removed from the empty shell 20 so that a screwdriver can be passed upward through access hole 28 in the bottom of the shell.

Figure 7:
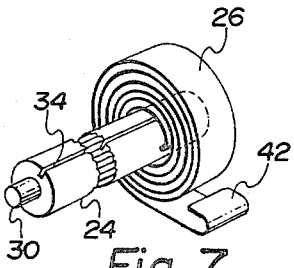
FIG. 7 is a broken perspective of the roller showing the rewind spring.

Once this shell has been mounted, the roller 24 is inserted into the shell such that roller axle 30 fits into a seat or bushing 32. The roller is provided with a slot 34 shown in FIG. 7 in which the resilient sheet 36 is inserted along one edge and subsequently wound as shown in FIG. 3. As the roller is inserted in the shell 20 with the axle 30 seating in the bushing 32 raised in the interior end of the shell, the sheet 36 is extended through outlet slot 38 in the shell where it is maintained by virtue of its connection to leading edge bar 40. Thus, when the installation of a roller is accomplished, the return spring 26 is coiled to achieve the proper tension subsequent to which the loop end 42 is engaged on the pin 44 on the interior side of the retainer cap 46 which is screwed to the open end of the shell 20 to define a complete housing for the roller. When this is done, the spindle 38 naturally engages in an axial opening in the end of the roller so that it is appropriately journaled within the housing.

Similarly mounted beneath the frame member 16 of the other armrest is a releasable catch mechanism 50. This structure includes a long channel-defining extrusion 52 which is bolted beneath the frame member and defines an open channel to the left in the drawings to seat the leading edge bar 40 attached to the resilient sheet. It will be noted that this leading edge bar is provided with an upwardly directed finger grip 54 so that it can be conveniently seated into the open channel of the catch mechanism.

Figure 2:
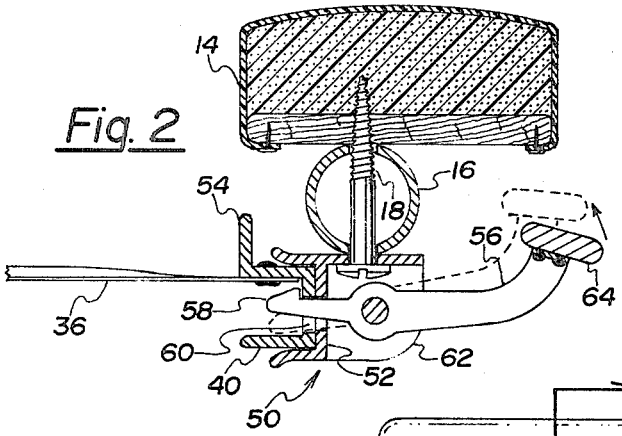
FIG. 2 is a section taken through line 2—2 of FIG. 5.

The catch mechanism includes a pair of journaled latch elements 56 pivoted as shown in FIG. 2 and having hooked ends 58 which pass through opening 60 in the leading edge 40 to latch the leading edge bar when these ends 58 are in their up position, shown in FIG. 2. The latch elements are journaled in brackets 62 and include a hand release bar 64 which is mounted in proximity to the overlying armrest 14 to permit the easy raising of same to free the latch element 56 from the bar 40 to release the resilient sheet tray member as shown in phanton in FIG. 2. Although the weight of this release bar 64, another structure would ordinarily be sufficient to maintain the hook ends 58 in the upper, engaged position, auxiliary catch springs could also be provided.

In use the finger grip 54 is seized by the wheelchair victim when the tray is in the position shown in FIG. 3, and the leading bar 40 is drawn over into engagement with the hooks 58 which snap into position, retaining the resilient tray member 36 in extended position. By virtue of the arch that the sheet defines crosswise of its length as best seen in FIG. 4, the support provided the sheet beneath the two armrests will be sufficient to hold the sheet in operative orientation without additional support. Retraction of the sheet of course is effected by gripping the member 54 with the right hand while releasing the bar 64 with the left hand. Clearly, a slight modification of this mechanism would permit release of the leading edge of the resilient sheet with a single hand while preventing it from snapping back into its housing.

In its entirety, the tray is easily installed on existing wheelchairs by virtue of this adaptation to the conventional screws 18 found on most wheelchairs, is lightweight, which is important as the vast majority of wheelchairs are propelled by the strength of the user, and is extremely inconspicuous and convenient when in its retracted position beneath the wheelchair armrest.

What is claimed is:

1. A retractable tray for a wheelchair having frame and two armrests, said tray comprising:

(a) a roller mechanism and means to mount same to said frame adjacent one of said armrests and a return spring for said roller;

(b) a releasable catch mechanism and means to mount same to a portion of said frame opposite said first armrest;

(c) a resilient sheet mounted at one end to said roller and being coilable into a retracted position around said roller and extendable into an extended position engaged by said catch means;

(d) said sheet defining a transverse upwardly convex arch across its width when extended to provide same with the structural strength necessary to pemit its use as a tray spanning the distance between said armrests without being under tension such that a one-armed or enfeebled person would be able to withdraw said mechanism against the spring load tension.

2. The structure according to claim 1 wherein said wheelchair has a frame and said frame includes a horizontal armrest support member beneath said first armrest, said roller mechanism includes a self-contained housing secured to said horizontal armrest support member, said releasable catch mechanism is mounted on a mounting bracket and said mounting bracket is mounted beneath the second armrest of said wheelchair, said resilient sheet has a leading edge bar, said catch mechanism comprises at least one detent biased to snap into engagement with said bar, and said catch mechanism includes a release bar extended alongside said second armrest such that upward pressure on said release bar releases said detent to permit an enfeebled or one-armed person to release said sheet by squeezing said bar upward toward the overlying armrest.

3. The structure according to claim 1 wherein said roller mechanism includes a housing comprising an elongated empty shell mountable beneath one of said armrests, a roller having said rewind spring thereon and insertable into one end of said shell, and a cap for said one end of said shell having means thereon to anchor said rewind spring.

* * * * *